US008347576B2

(12) United States Patent
Yang et al.

(10) Patent No.: US 8,347,576 B2
(45) Date of Patent: Jan. 8, 2013

(54) MECHANICALLY EMBOSSED SINGLE PLY ROOFING MEMBRANE FOR ANTI-ROLL BLOCKING

(75) Inventors: Li-Ying Yang, Whippany, NJ (US); Edward Nebesnak, Mine Hill, NJ (US); William P. Kuhn, Boonton, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 2818 days.

(21) Appl. No.: 10/798,595

(22) Filed: Mar. 11, 2004

(65) Prior Publication Data

US 2005/0210802 A1 Sep. 29, 2005

(51) Int. Cl.
*E04B 5/00* (2006.01)

(52) U.S. Cl. ..... 52/409; 52/411

(58) Field of Classification Search ..... 52/408, 52/411, 506.01; 428/156, 167, 172
See application file for complete search history.

(56) References Cited

U.S. PATENT DOCUMENTS

| | | | | |
|---|---|---|---|---|
| 2,103,076 | A | 12/1937 | Harshberger et al. | |
| 2,782,129 | A | 2/1957 | Donegan | |
| 3,446,685 | A * | 5/1969 | Neumann et al. | 156/219 |
| 4,695,501 | A * | 9/1987 | Robinson | 428/159 |
| 4,715,915 | A * | 12/1987 | Vanderzee | 156/182 |
| 5,195,290 | A | 3/1993 | Hulett | |
| 6,134,856 | A | 10/2000 | Khan et al. | 52/536 |
| 6,544,909 | B1 | 4/2003 | Venkataswamy et al. | 442/38 |
| 6,878,238 | B2 * | 4/2005 | Bakken et al. | 162/362 |
| 7,294,238 | B2 * | 11/2007 | Bakken et al. | 162/362 |

FOREIGN PATENT DOCUMENTS

JP 10206819 8/1998

* cited by examiner

*Primary Examiner* — Basil Katcheves
(74) *Attorney, Agent, or Firm* — Thompson Hine L.L.P.

(57) ABSTRACT

A single ply mechanically embossed roofing membrane in a roll form for use in commercial applications on flat and low pitched roofs. The roofing membrane preferably includes a scrim or reinforcement sheet sandwiched between a top layer and a bottom layer, wherein the bottom layer is completely embossed with various configurations forming alternating ridges and valleys. The embossed roofing membrane improves roll blocking upon installation. The embossed roofing membrane can be installed by fully adhering or mechanically attaching to the roof deck.

31 Claims, 6 Drawing Sheets

MECHANICALLY EMBOSSED SINGLE PLY ROOFING MEMBRANE FOR ANTI-ROLL BLOCKING

BACKGROUND OF THE INVENTION

1. Field of the Invention

This invention relates to a single ply roofing membrane having a top layer and a bottom layer for covering industrial and commercial flat and pitched roofs. More particularly, the invention relates to a single ply reinforced roofing membrane in which the bottom layer is embossed to improve roll blocking without sacrificing the heat seaming performance of the roofing membrane.

2. Reported Developments

Single ply roofing membranes to cover flat and pitched roofs are known in the art of commercial roofing membranes. Some membranes comprise bottom and top polyolefin-based sheets with a fiber reinforcement scrim sandwiched between the sheets. To promote adhesion between the scrim and the polyolefin sheets, a highly flowable, functional-polyolefin is incorporated into one or both sheets as disclosed in U.S. Pat. No. 6,544,909.

Other membranes of the prior art consist of materials based on atactic polypropylene (APP) modified bitumen. Still other membranes consist primarily of materials based on styrene-butadiene-styrene (SBS) modified bitumen. Attachment of these membranes to underlying roof decks are accomplished with adhesives and/or screws. To adhere one membrane to another membrane to render the roof covering waterproof, the selvage edge of one membrane is overlapped with the selvage edge of the next membrane. A torch is then used to soften the membranes at their overlapped portions to achieve a seam sufficient to withstand weather conditions.

U.S. Pat. No. 6,134,856 discloses a roll roof membrane , and a method for its preparation, which obviates the use of a torch to achieve a seam between the overlapped portions of the membranes. The roof membrane comprises a support sheet having bonded on the top and bottom surfaces thereof layers comprising APP modified bitumen, a first selvage edge disposed in the top APP modified bitumen layer along one side of the membrane, a second selvage edge disposed in the bottom APP modified bitumen layer along the opposite side of the membrane, and wherein each of the selvage edges have a series of embossed ridges and valleys adopted to accept adhesives, the valleys extending substantially through the APP modified bitumen layers to the support sheet.

The method of preparing the roll roof membrane includes the steps of: a roll of support sheet is unwound and passed through an accumulator; the unwound sheet is dip coated by immersion in a coating vat containing molten compounded APP, asphalt, and one or more fillers and fire retardants; while the coatings are in a molten state, the selvage edges on opposite sides and opposite surfaces of the membrane are contacted with top side embosser and bottom side embosser; the APP modified bitumen layers are cooled and solidified by floating the membrane in a water bath and the membrane is wound into a roll. A suitable liquid parting agent, such as a coconut oil, can be added to the bottom surface of the membrane to reduce the tendency for the membrane to stick during winding and subsequent handling.

We have observed that roll blocking tends to occur with single ply membranes of the prior art. As the membranes are produced, they are wound into rolls, stored in roll configurations and delivered to the site of installation. Since the membrane is smooth, portions thereof tend to stick and adhere to each other thereby hindering the unwinding process.

Embossment of selvage edges on opposite sides and opposite surfaces of the membrane does not appear to solve the roll blocking problem: while the embossed portions of the membrane easily unwind, the remaining portions constituting the majority of the surface area tend to stick and adhere to each other.

We have now discovered that the roll blocking problem can be greatly reduced by the complete embossment of the bottom layer of the single ply membrane.

SUMMARY OF THE INVENTION

In accordance with the present invention, there is provided a single ply roofing membrane for covering industrial and commercial flat and pitched roofs. The single ply roofing membrane comprises: a bottom layer and a top layer wherein the layers are permanently bound together, and the bottom layer is embossed with various patterns to increase the surface area of the membrane.

In a preferred embodiment of the present invention the single ply roofing membrane comprises: a top layer of a polyolefin, a bottom layer of a polyolefin, and a fibrous reinforcing scrim sandwiched between the top and bottom layers wherein the bottom layer is embossed with various patterns. Suitable polyolefins are polymers including polyethylene, polypropylene, terpolymers of ethylene, propylene and diene monomers, ethylene-propylene copolymers, ethylene-butane copolymers, ethylene-hexane copolymers, ethylene-octane copolymers, propylene-$C_{4-8}$ alpha olefin copolymers, and metallocene polyolefins. In order to improve adhesion between top and bottom layers and the reinforcing scrim, a small amount, preferably about 0.5-20% w/w, and more preferably about 1-10% w/w, and most preferably about 1-5% w/w of a highly-flowable, functional polyolefin is incorporated into one or both polyolefin layers. A maleic anhydride-modified polyolefin (CK Witco), an epoxy-modified polyethylene (Elf Atochem) and methacrylate terpolymers thereof (Elf Atochem) are preferred. The thickness of the membrane preferably ranges from 0.1 to 5 mm (4 to 200 mils), and more preferably from 0.6 to 2.5 mm (25 to 100 mils).

The fibrous reinforcing scrim is preferably of fiberglass and/or polyester. However, woven or non-woven fabrics may also be used. The tenacity of the scrim can range from about 100 to 3000 denier, preferably 500 to 1500, and most preferably 1000 denier. Preferred support scrims have a tensile strength greater than about 14 KN per meter (80 pounds force per inch).

The bottom layer of the single ply roofing membrane is embossed with various patterns which includes: a polyhedron with a polygonal base and triangular faces meeting in a common vertex, such as a pyramidal base; a cone configuration having a circular or ellipsoidal configurations; and random pattern configurations. The depth of the embossments can be about 0.01 to 2 mm (0.4 to 80 mils), preferably 0.025 to 0.5 mm (1 to 20 mils), and most preferably 0.05 to 0.25 mm (2 to 10 mils).

DETAILED DESCRIPTION OF THE INVENTION

The invention being described is with reference to the preferred embodiments described in the Summary of the Invention with respect to the top and bottom layers and the scrim sandwiched between the layers. However, the invention also finds utility with other scrims or support sheets made of papers and film. In the description that follows like numerals denote like components.

Figure 1:
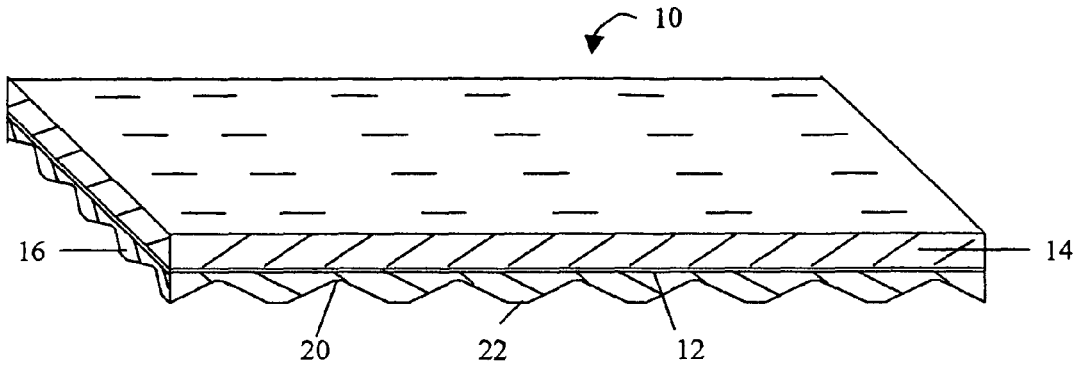
FIG. 1 is a perspective view of a single ply roof membrane showing the embossed bottom layer in profile, and the unembossed top layer.
Figure 2:
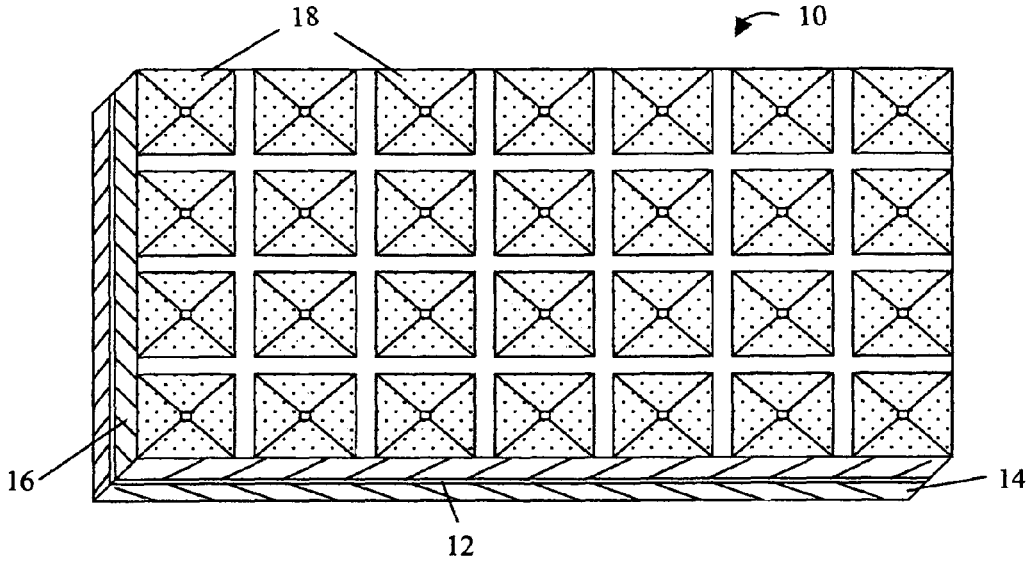
FIG. 2 is a bottom plan view of the single ply roof membrane depicted in FIG. 1 showing the bottom layer embossed with a rectangular base pyramidal configuration.
Figure 3:
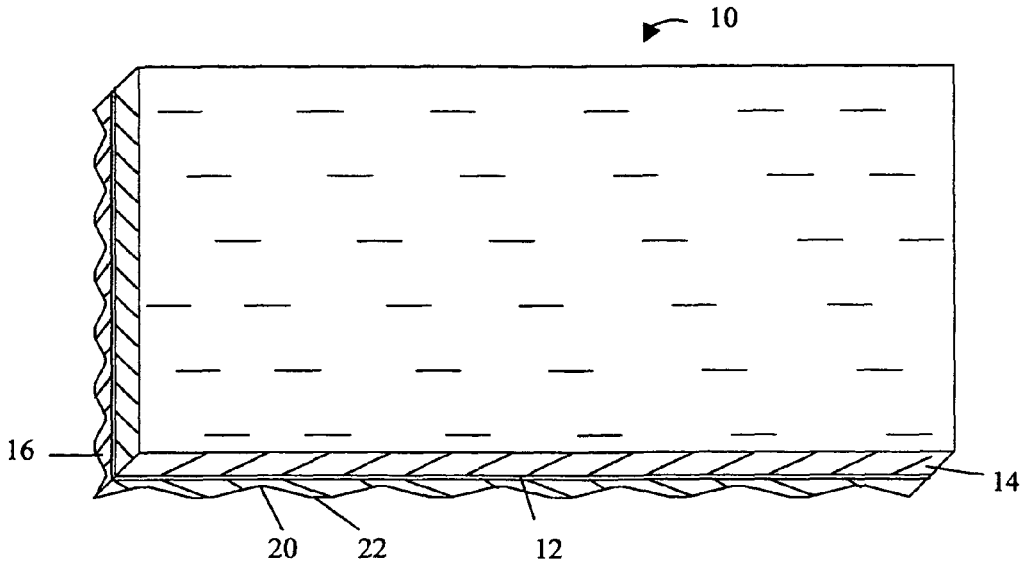
FIG. 3 is a side view of the single ply roof membrane depicted in FIG. 1 showing the unembossed top layer and the embossed bottom layer in profile.

FIGS. 1-3 illustrate a single ply roof membrane 10 comprising a scrim or support sheet 12, top layer 14, and a bottom layer 16 which layers sandwich the scrims or support sheet therebetween. The bottom layer is embossed with a rectangular base pyramidal configuration 18 having a series of ridges 22 and valleys 20.

Figure 4:
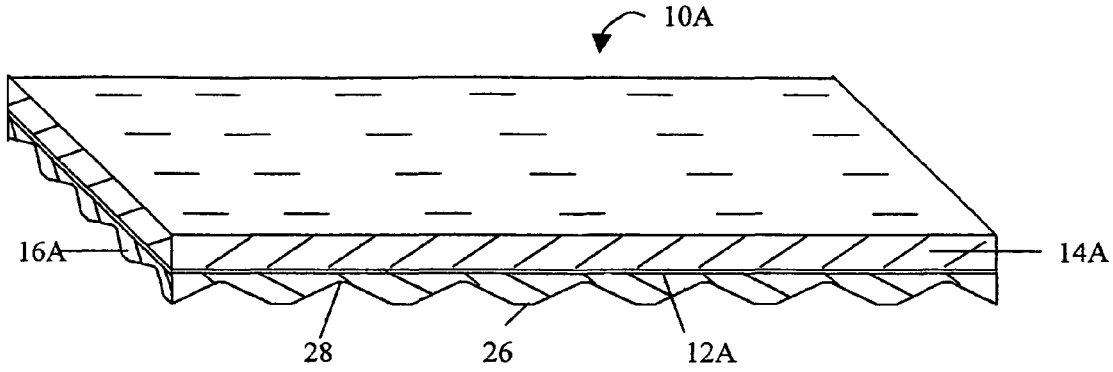
FIG. 4 is a perspective view of another single ply roof membrane showing the embossed bottom layer in profile, and the unembossed top layer.
Figure 5:
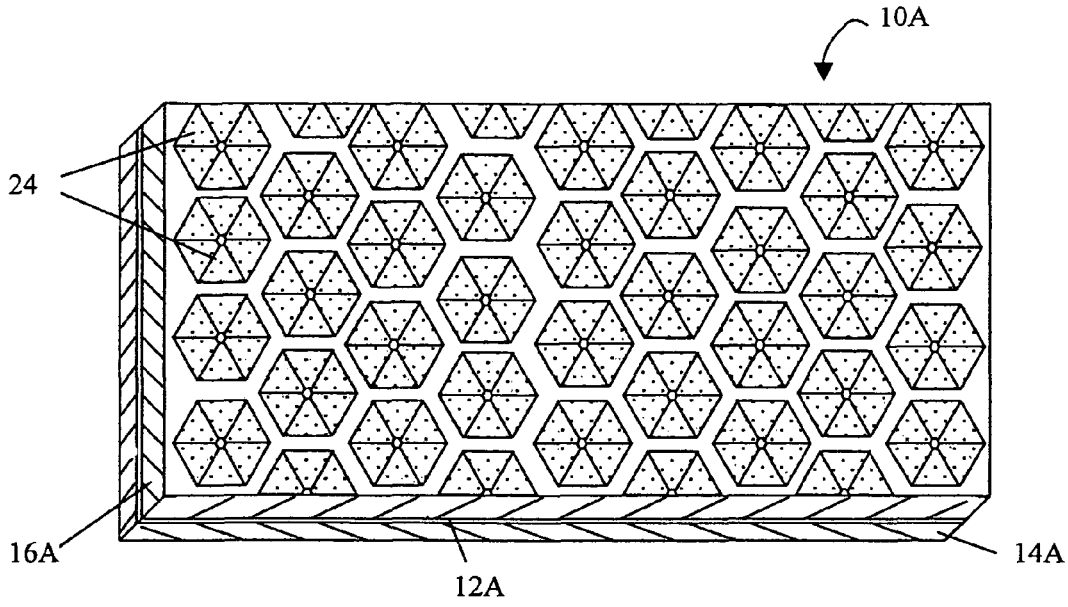
FIG. 5 is a bottom plan view of the single ply roof membrane depicted in FIG. 4 showing the bottom layer embossed with a hexagonal base pyramidal configuration.
Figure 6:
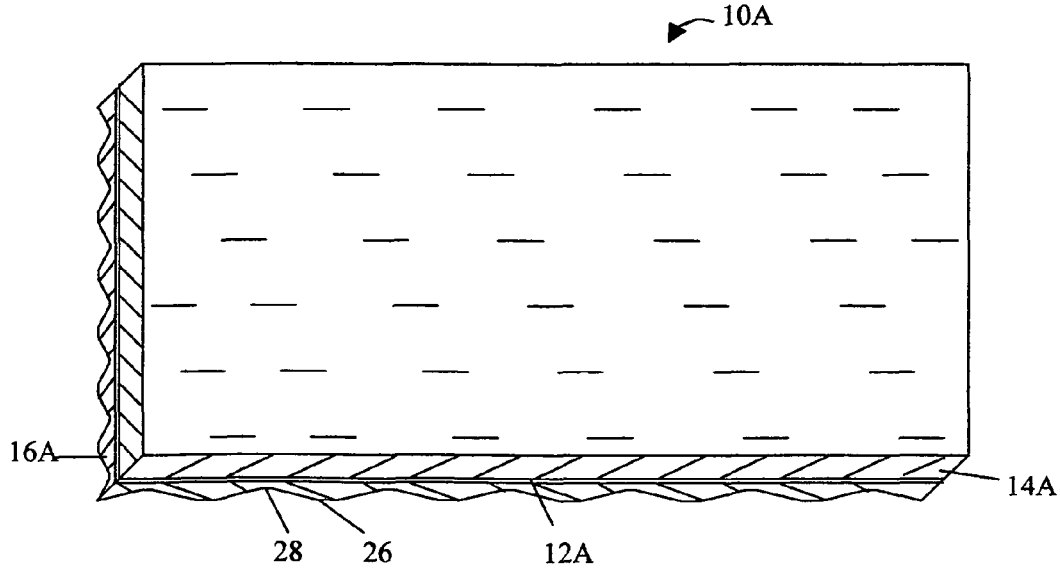
FIG. 6 is a side view of the single ply roof membrane depicted in FIG. 4 showing the unembossed top layer and the embossed bottom layer in profile.

FIGS. 4-6 illustrate another single ply roof membrane 10A comprising a scrim or support sheet 12A, a top layer 14A, and a bottom layer 16A which layers sandwich the scrim or support sheet therebetween. The bottom layer is embossed with a hexagonal base configuration 24 having a series of ridges 26 and valleys 28.

Figure 7:
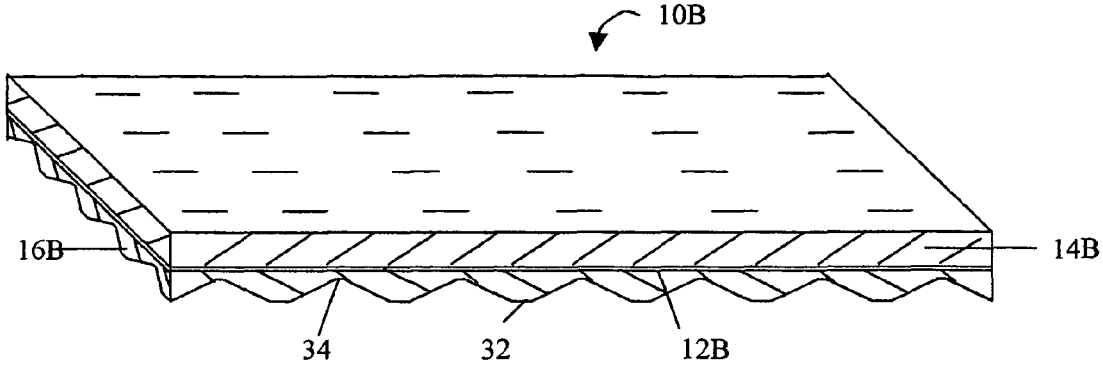
FIG. 7 is a perspective view of still another single ply roof membrane showing the embossed bottom layer in profile, and the unembossed top layer.
Figure 8:
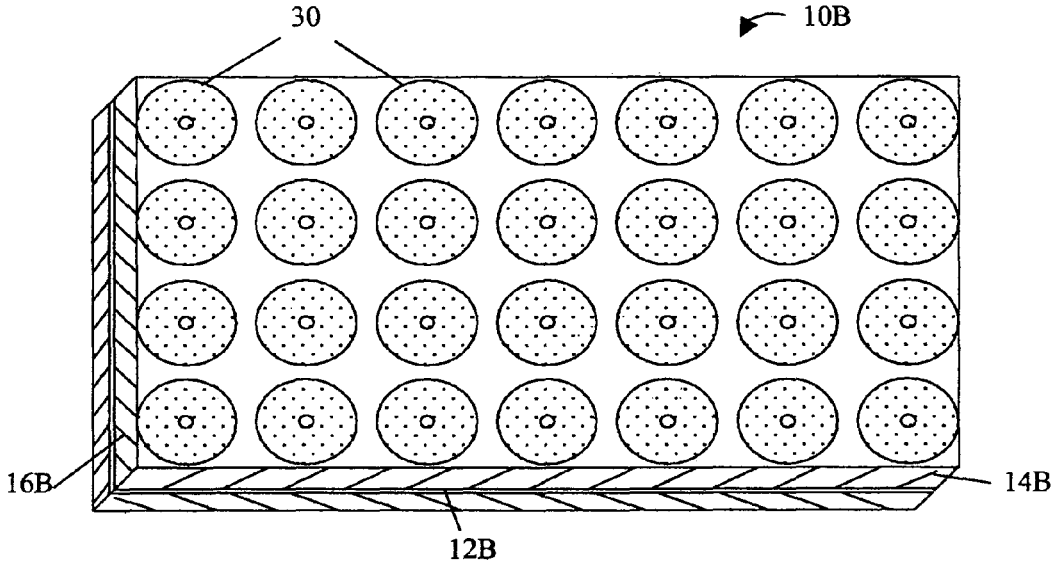
FIG. 8 is a bottom plan view of the single play roof membrane depicted in FIG. 7 showing the bottom layer embossed with a cone-shaped, circular base configuration.
Figure 9:
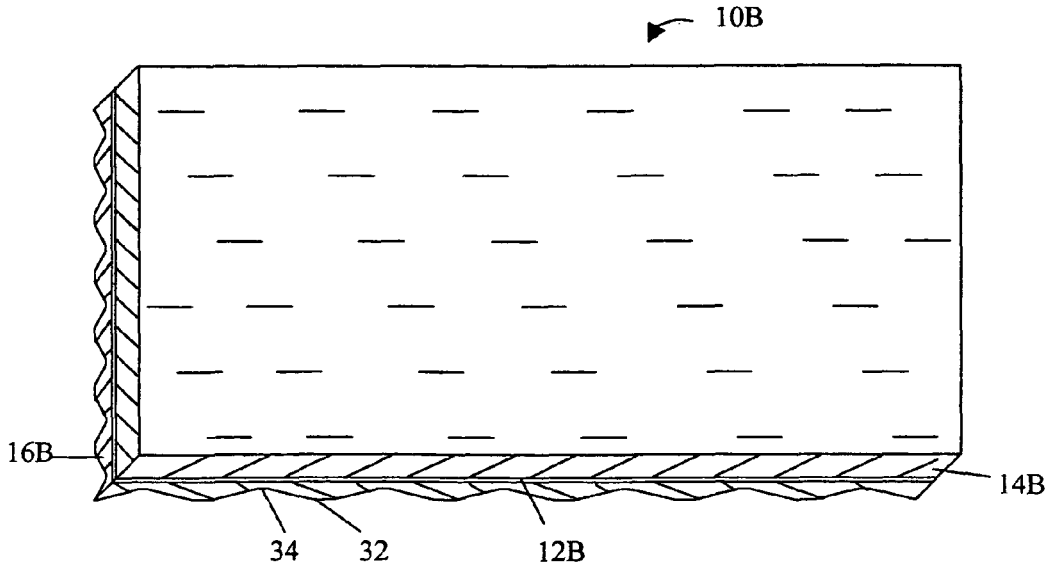
FIG. 9 is a side view of the single ply roof membrane depicted in FIG. 7 showing the unembossed top layer and the embossed bottom layer in profile.

FIGS. 7-9 illustrate still another single ply roof membrane 10B comprising a scrim or support sheet 12B, a top layer 14B, and a bottom layer 16B which layers sandwich the scrim or support sheet therebetween. The bottom layer is embossed with a cone-shaped, circular base configuration 30 having a series of ridges 32 and valleys 34.

Figure 10:
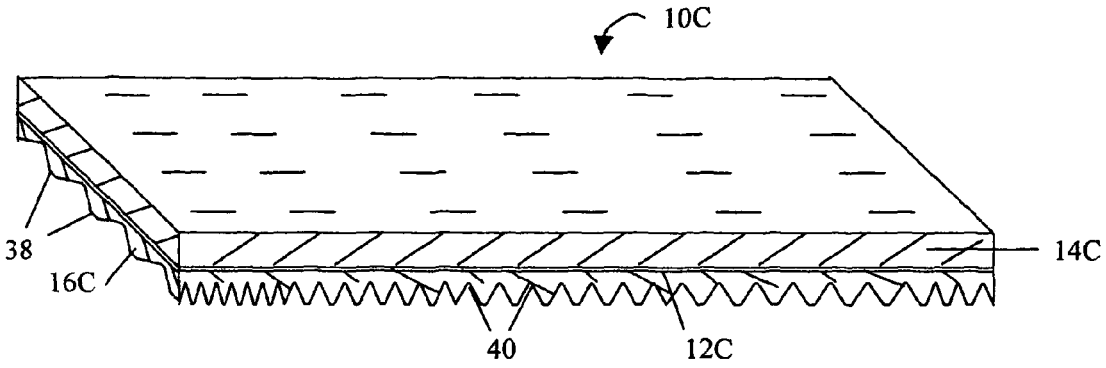
FIG. 10 is a perspective view of another single ply roof membrane showing the embossed bottom layer in profile, and the unembossed top layer.
Figure 11:
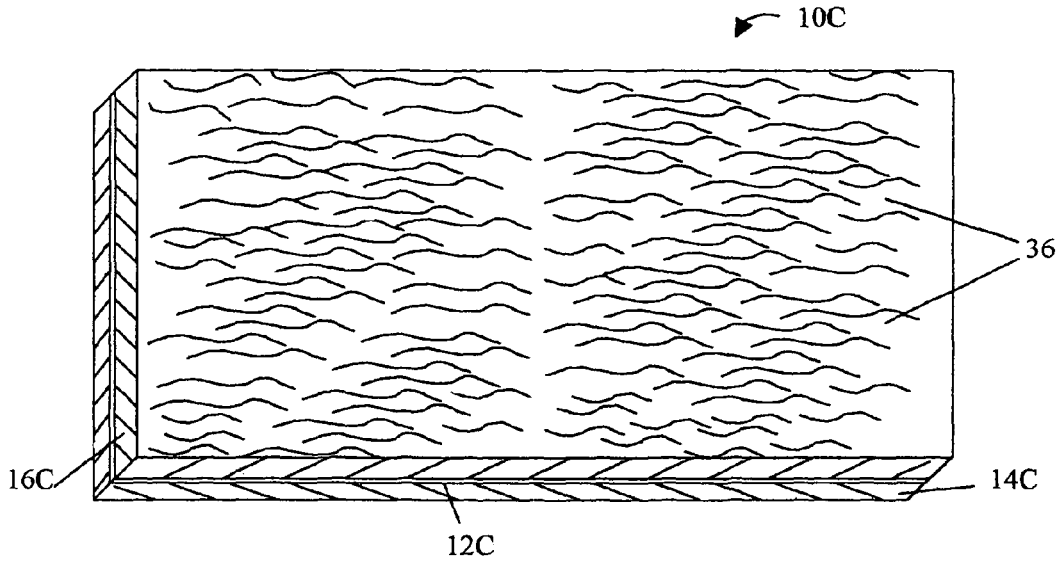
FIG. 11 is a bottom plan view of the single ply roof membrane depicted in FIG. 10 showing the bottom layer embossed with random longitudinally running designs.
Figure 12:
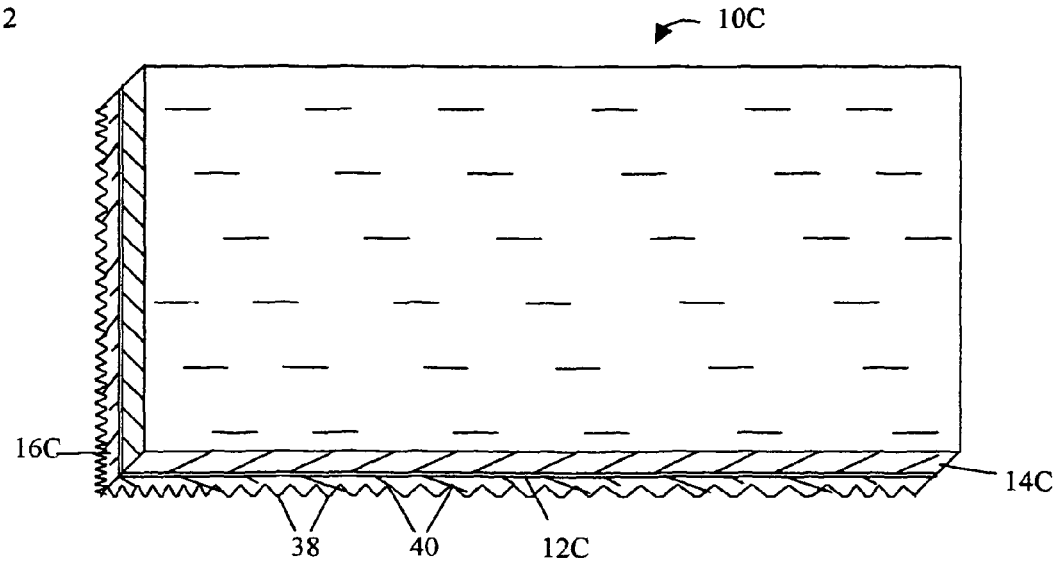
FIG. 12 is a side view of the single ply roof membrane depicted in FIG. 10 showing the unembossed top layer, and the embossed bottom layer in profile.

FIGS. 10-12 illustrate a further single ply roof membrane 10C comprising a scrim or support sheet 12C, a top layer 14C, and a bottom layer 16C which layers sandwich the scrim or support sheet therebetween. The bottom layer is embossed with random thread-like filaments 36 randomly spaced from each other and running longitudinally on the single ply roof membrane having a series of ridges 38 and valleys 40.

Figure 13:
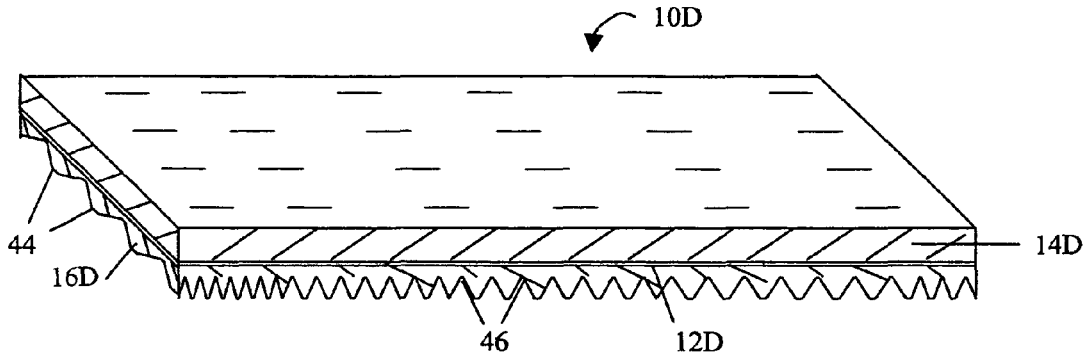
FIG. 13 is a perspective view of another single ply roof membrane showing the embossed bottom layer in profile, and the unembossed top layer.
Figure 14:
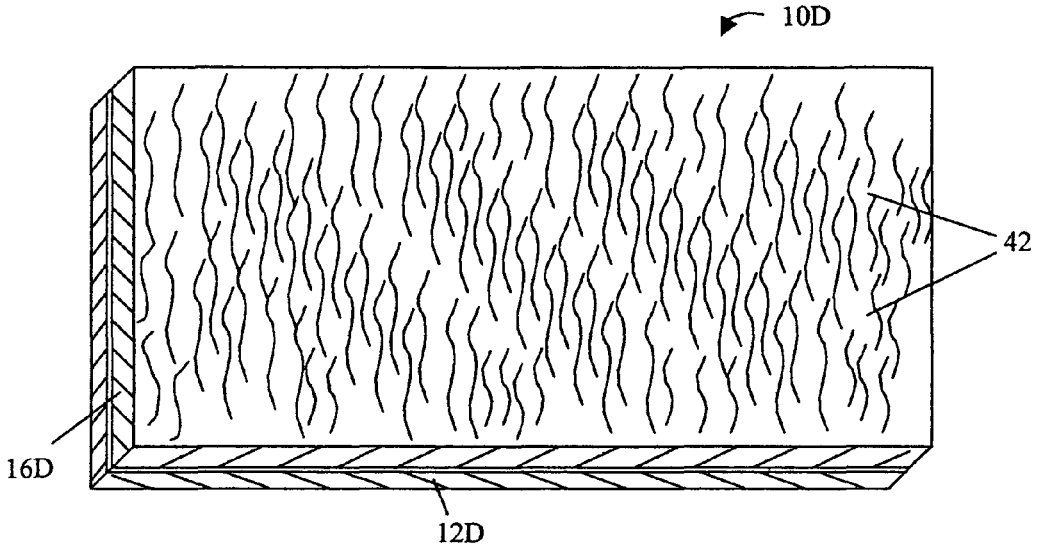
FIG. 14 is a bottom plan view of the single ply roof membrane depicted in FIG. 13 showing the bottom layer embossed with random transversely running designs.
Figure 15:
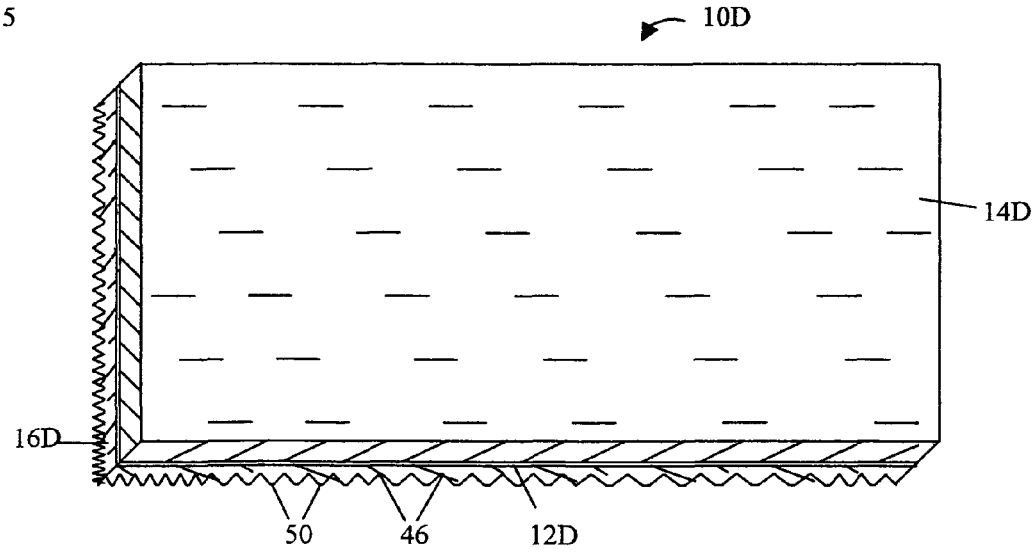
FIG. 15 is a side view of the single ply roof membrane depicted in FIG. 13 showing the unembossed top layer, and the embossed bottom layer in profile.

FIGS. 13-15 illustrate still another single ply roof membrane 10D comprising a scrim or support sheet 12D, a top layer 14D, and a bottom layer 16D which layers sandwich the scrim or support sheet therebetween. The bottom layer is embossed with random thread-like filaments 42 randomly spaced from each other and running. transversely on the single ply roof membrane having a series of ridges 44 and valleys 46.

Figure 16:
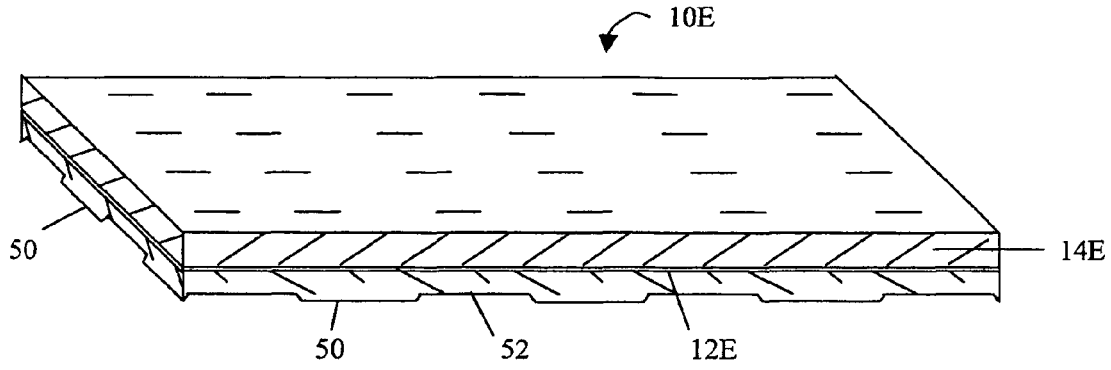
FIG. 16 is a perspective view of another single ply roof membrane showing the embossed bottom layer in profile, and the unembossed top layer.
Figure 17:
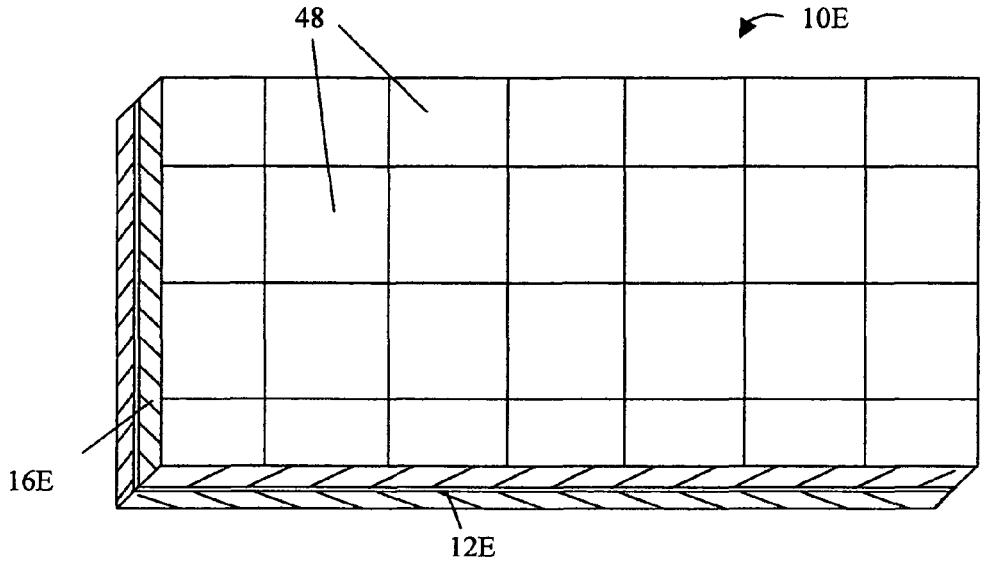
FIG. 17 is a bottom plan view of the single ply roof membrane depicted in FIG. 16 showing the bottom layer embossed with random interwoven basket-weave designs.
Figure 18:
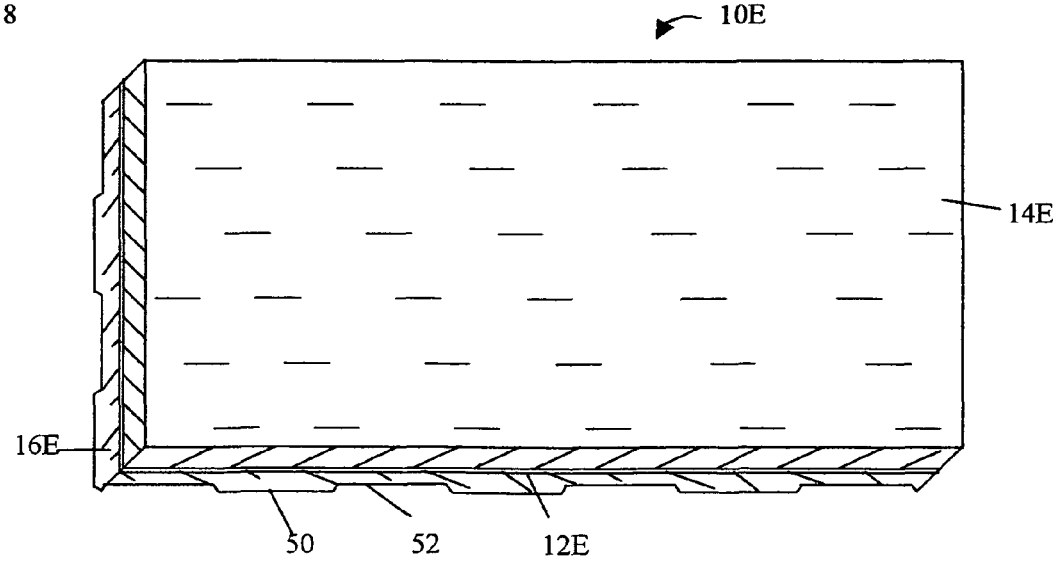
FIG. 18 is a side view of the single ply roof membrane depicted in FIG. 16 showing the unembossed top layer, and the embossed bottom layer in profile.

FIGS. 16-18 illustrate a still further single ply roof membrane 10E comprising a scrim or support sheet 12E, a top layer 14E, and a bottom layer 16E which layers sandwich the scrim or support sheet therebetween. The bottom layer is embossed with basket-weave patterns 48 randomly spaced from each other having a series of ridges 50 and valleys 52.

In addition to the random patterns shown in FIGS. 10-18, other random patterns of embossments may be used including the geometrical shapes shown in FIGS. 1-9 wherein the shapes are randomly spaced from each other. In all embodiments of the present invention it is important that the various patterns of embossments increase the surface area of the membrane thereby decreasing the roll blocking tendency of the membrane.

In preparing the single ply roofing membrane conventional equipment and methods are used which are well known in the prior art. Such methods include extrusion coating and calendaring. The embossing rolls useful herein are known in the art and/or modified as described herein.

The single ply roll membranes typically have a width of about 1 to 5 meters (3 to 15 feet), while the length of the membranes may be about 15 meters (50 feet) or more.

The single ply roofing membranes are used with an appropriate adhesive which is painted or sprayed on the unfolded membrane prior to the installation; or can be mechanically attached using techniques well known to those skilled in the art. In both systems, the membranes are rolled out prior to the installation. Blocking tests were conducted on the embossed membranes of the present invention in roll forms, and on unembossed membranes of the prior art in roll forms as control based on ASTM D-751 method. The control samples showed 100% blocking while the membranes of the present invention showed about 25% blocking.

LIST OF PARTS

| | |
|---|---|
| Singly ply roof membrane, generally designated | 10, 10A, 10B, 10C, 10D, 10E |

-continued

| LIST OF PARTS | |
|---|---|
| Support scrim or sheet | 12, 12A, 12B, 12C, 12D, 12E |
| Top layer | 14, 14A, 14B, 14C, 14D, 14E |
| Bottom layer | 16, 16A, 16B, 16C, 16D, 16E |
| Rectangular based pyramidal configuration | 18 |
| Valleys in the rectangular based pyramidal configuration | 20 |
| Ridges in the rectangular based pyramidal configuration | 22 |
| Hexagonal based pyramidal configuration | 24 |
| Ridges in the hexagonal based pyramidal configuration | 26 |
| Valleys in the hexagonal based pyramidal configuration | 28 |
| Cone-shaped, circular based configuration | 30 |
| Ridges in cone-shaped, circular based configuration | 32 |
| Valleys in cone-shaped, circular based configuration | 34 |
| Filaments running longitudinally | 36 |
| Ridges in filaments embossment | 38 |
| Valleys in filaments embossment | 40 |
| Filaments running transversely | 42 |
| Ridges in filaments embossment | 44 |
| Valleys in filaments embossment | 46 |
| Basket-weave pattern | 48 |
| Ridges in basket-weave design | 50 |
| Valleys in basket-weave design | 52 |

The invention has been described with reference to certain preferred embodiments thereof, however, it is to be understood that variations and modifications can be effected within the spirit and scope of the invention.

What is claimed is:

1. A mechanically embossed single ply roofing membrane comprising: a top layer and a bottom layer permanently pressed into a single ply membrane wherein said bottom layer is mechanically embossed forming an embossment of alternating ridges and valleys over a majority of the surface area of the bottom layer.

2. The mechanically embossed single ply roofing membrane of claim 1 wherein said embossment is of pyramidal configuration having a rectangular base.

3. The mechanically embossed single ply roofing membrane of claim 1 wherein said embossment is of pyramidal configuration having a hexagonal base.

4. The mechanically embossed single ply roofing membrane of claim 1 wherein said embossment is of cone configuration having a circular or ellipsoidal base.

5. The mechanically embossed single ply roofing membrane of claim 1 wherein said embossment is of randomly spaced thread configuration running longitudinally in said single ply roofing membrane.

6. The mechanically embossed single ply roofing membrane of claim 1 wherein said embossment is of randomly spaced thread configuration running transversely in said single ply roofing membrane.

7. The mechanically embossed single ply roofing membrane of claim 1 wherein said embossment is of basket-weave configuration running longitudinally, or transversely in said single ply roofing membrane.

8. The mechanically embossed single ply roofing membrane of claim 1 wherein said top layer and said bottom layer is of a polyolefin.

9. The mechanically embossed single ply roofing membrane of claim 8 wherein said polyolefin is selected from the group consisting of polyethylene, polypropylene, terpolymers of ethylene, propylene and diene monomers, ethylene-propylene copolymers, ethylene-butane copolymers, ethylene-hexane copolymers, ethylene-octane copolymers, propylene-$C_{4-8}$ alpha olefin copolymers, and metallocene polyolefins.

10. The mechanically embossed single ply roofing membrane of claim 1 wherein said embossment having a depth of about 0.01 to 2 mm (0.4 to 80 mils).

11. A method of installing a mechanically embossed single ply roofing membrane on a roof deck comprising the steps of:

providing the roofing membrane of claim 1 in a roll form;

unrolling a desired length of said roofing membrane at the site of installation;

fully adhering or mechanically attaching the single ply roofing membrane on a roof deck; and continuing the process to complete the coverage of the roof deck.

12. A mechanically embossed single ply roofing membrane comprising: a reinforcement scrim sandwiched between a top layer of polyolefin and a bottom layer of polyolefin permanently pressed into a single ply membrane wherein said bottom layer is mechanically embossed forming an embossment of alternating ridges and valleys over a majority of the surface area of the bottom layer.

13. The mechanically embossed single ply roofing membrane of claim 12 wherein said reinforcement scrim is of a material selected from the group consisting of fiberglass, polyester, fiberglass reinforced polyester, woven fabrics and non-woven fabrics.

14. The mechanically embossed single ply roofing membrane of claim 12 wherein about 0.5% to 20% w/w of a highly-flowable, functional polyolefin is incorporated into said top layer or said bottom layer to improve adhesion between said reinforcement scrim and said top layer and said bottom layer.

15. The mechanically embossed single ply roofing membrane of claim 14 wherein said highly-flowable, functional polyolefin is selected from the group consisting of maleic anhydride-modified polyolefin, epoxy-modified polyethylene and methacrylate terpolymers thereof.

16. The mechanically embossed single ply roofing membrane of claim 12 having a thickness of about 0.1 to 5 mm (4 to 200 mils).

17. The mechanically embossed single ply roofing membrane of claim 16 having a thickness of about 0.6 to 2.5 mm (25 to 100 mils).

18. The mechanically embossed single ply roofing membrane of claim 16 wherein said scrim having tenacity of 100 to 3000 denier.

19. The mechanically embossed single ply roofing membrane of claim 16 having a tensile strength of at least 80 pounds force per inch.

20. The mechanically embossed single ply roofing membrane of claim 12 wherein said embossment is of pyramidal configuration having a rectangular base.

21. The mechanically embossed single ply roofing membrane of claim 12 wherein said embossment is of pyramidal configuration having a hexagonal base.

22. The mechanically embossed single ply roofing membrane of claim 12 wherein said embossment is of cone configuration having a circular or ellipsoidal base.

23. The mechanically embossed single ply roofing membrane of claim 12 wherein said embossment is of randomly spaced thread configuration running longitudinally in said single ply roofing membrane.

24. The mechanically embossed single ply roofing membrane of claim 12 wherein said embossment is of randomly spaced thread configuration running transversely in said single ply roofing membrane.

25. The mechanically embossed single ply roofing membrane of claim 12 wherein said embossment is of basket-weave configuration running longitudinally, or transversely in said single ply roofing membrane.

26. The mechanically embossed single ply roofing membrane of claim 12 wherein said polyolefin is selected from the group consisting of polyethylene, polypropylene, terpolymers of ethylene, propylene and diene monomers, ethylene-propylene copolymers, ethylene-butane copolymers, ethylene-hexane copolymers, ethylene-octane copolymers, propylene-$C_{4-8}$ alpha olefin copolymers, and metallocene polyolefins.

27. A method of installing a mechanically embossed single ply roofing membrane on a roof deck comprising the steps of:

providing the roofing membrane of claim 12 in a roll form;

unrolling a desired length of said roofing membrane at the site of installation;

fully adhering or mechanically attaching the single ply roofing membrane on a roof deck; and continuing the process to complete the coverage of the roof deck.

28. A method of making a mechanically embossed reinforced single ply roofing membrane comprising:

providing a scrim or reinforcement sheet having top and bottom surfaces;

depositing a coating in a molten state on said top and bottom surfaces of said scrim or reinforcement sheet;

embossing said bottom surface with a pattern of ridges and valleys over a majority of the surface area of the bottom layer; and solidifying the molten coating on the top and bottom surfaces of said scrim or reinforcement sheet.

29. The method of claim 28 wherein said coating is a polyolefin.

30. A method of making a mechanically embossed non-reinforced single ply roofing membrane comprising:

extruding and calendering a molten polyolefin sheet embossing a majority of the bottom surface of said non-reinforced sheet with a pattern of ridges and valleys; and solidifying the molten non-reinforced sheet.

31. The method of claim 30 wherein said sheet further comprises a functional polyolefin.

* * * * *